United States Patent [19]

Rutkowski et al.

[11] 3,974,081

[45] Aug. 10, 1976

[54] BIODEGRADABLE SEAL SWELL ADDITIVE WITH LOW TOXICITY PROPERTIES FOR AUTOMATIC TRANSMISSION FLUIDS, POWER TRANSMISSION FLUIDS AND ROTARY ENGINE OIL APPLICATIONS

[75] Inventors: Alfred J. Rutkowski, Colonia; John P. Szykowski, Edison, both of N.J.

[73] Assignee: Exxon Research and Engineering Company, Linden, N.J.

[22] Filed: July 31, 1974

[21] Appl. No.: 493,243

[52] U.S. Cl. ..... 252/79; 252/57; 252/76

[51] Int. Cl.[2] ..... C10M 1/26; C09K 3/00

[58] Field of Search ..... 252/79, 76, 73, 57

[56] References Cited

UNITED STATES PATENTS

| | | | |
|---|---|---|---|
| 1,698,973 | 1/1929 | Tseng | 252/76 |
| 2,134,736 | 11/1938 | Reuter | 252/57 |
| 2,199,187 | 4/1940 | Rosen | 252/57 |
| 2,215,590 | 9/1940 | Maverick | 252/57 |
| 2,710,842 | 6/1955 | Heisig et al. | 252/79 X |
| 3,039,967 | 6/1962 | Henry et al. | 252/79 X |
| 3,389,088 | 6/1968 | Schar et al. | 252/73 |
| 3,446,737 | 5/1969 | Panzer et al. | 252/76 X |
| 3,591,497 | 7/1971 | Walker | 252/75 X |
| 3,629,114 | 12/1971 | Fairing | 252/78 X |
| 3,843,535 | 10/1974 | Denis et al. | 252/79 X |

*Primary Examiner*—Harris A. Pitlick
*Attorney, Agent, or Firm*—Roland A. Dexter; Frank T. Johmann

[57] ABSTRACT

A fluid having a mineral lubricating oil base and containing an oil soluble, saturated aliphatic or aromatic hydrocarbon ester having from 10 to 60 carbon atoms which, if desired, can be used in combination with an aliphatic alcohol of from 8 to 13 carbon atoms. The ester alone and ester-alcohol combination imparts to the fluid the property of swelling seals in automatic transmissions, power transmissions and rotary engines, and thereby improves retention of the fluid in these mechanical structures.

10 Claims, No Drawings

BIODEGRADABLE SEAL SWELL ADDITIVE WITH LOW TOXICITY PROPERTIES FOR AUTOMATIC TRANSMISSION FLUIDS, POWER TRANSMISSION FLUIDS AND ROTARY ENGINE OIL APPLICATIONS

BACKGROUND OF THE INVENTION

The present invention relates to an improved lubricating fluid and particularly concerns an additive for such a fluid that will improve its seal swelling properties without at the same time imparting any detrimental effects thereto. The invention is also directed to additive concentrate packages that are intended for formulation into mineral oil base stocks to provide transmission fluids of improved seal swelling characteristics thereby enhancing fluid retention. These transmission fluids have utility as a lubricant for rotary engines.

A very high percentage of vehicles such as automobiles, tractors and earthmovers are now equipped with some type of semi-automatic or fully automatic transmission. These transmissions must be provided with a supply of fluid that serves the multiple functions of a power transmitting medium, a hydraulic control fluid, a heat transfer medium, and a satisfactory lubricant. A transmission fluid to be useful must be capable of operating over a wide temperature range, possess a high degree of oxidation resistance, be free of corrosive action, have foam control, have satisfactory low temperature fluidity, retain a useful viscosity at high temperatures, have transmission seal compatibility and lubricity without "stick-slip" of the transmission parts.

Exemplary of automatic transmission fluids are those disclosed in U.S. patents: U.S. Pat. No. 3,410,801 which is directed to a class of modifiers of the friction characteristics of automatic transmission fluids (hereinafter designated ATF) to reduce squawk and chatter of the transmission; U.S. Pat. No. 3,446,737 which is directed to an alternative class of friction modifiers for ATF, i.e. to reaction products of $C_{50}$ to $C_{250}$ carboxylic acids with amines: U.S. Pat. No. 3,451,930 which is directed to the high stress additives for ATF; and U.S. Pat. No. 3,309,967 which is directed to a further class of friction modifiers for ATF, i.e. the dialkyl esters of dimers of ethylene monocarboxylic aliphatic acids.

The current approach to improving ATF is to adjust and modify the various additives so as to extend their useful life time. This approach is of little value unless the fluid is retained within the transmission system. Many of the automatic transmission in use in vehicles at the present time are losing significant quantities for automatic transmission fluid, principally because of deterioration of the rubber-type seals or gaskets. As a result of this there have been numerous attempts to develop oil-soluble additives that can be formulated with or added to the ATF automatic transmission to swell and soften the rubber in those seals and gaskets and thereby enhance retention. The seal swell-soften additive should not lower the viscosity of the automatic transmission fluid nor impair its oxidation stability. Further, the additive preferably should be biodegradable and not have adverse toxicological properties. The essential need is to improve the ATF originally placed in transmissions so that it is more completely and longer retained.

U.S. Pat. No. 3,389,088 teaches one class of additives which performs to suitably swell the various gaskets and seals of the automatic transmission system.

This class is aliphatic alcohols of 8 to 13 carbon atoms, e.g. tridecyl alcohol.

SUMMARY OF THE INVENTION

In accordance with the present invention, it has been found that the foregoing described problems can be alleviated by the modification of the ATF with an oil soluble, saturated, aliphatic or aromatic hydrocarbon ester having from 10 to 60 carbon atoms and from 2 to 4 ester linkages. For some applications it is desired that an aliphatic alcohol having from 8 to 13 carbon atoms be present in up to equal amounts with said ester as a co-swellant. Preferred among the above class of esters is dihexyl phthalate and among the above class of alcohols is tridecyl alcohol.

Modification of the ATF can be accomplished in several modes of operation including direct addition of said ester or ester-alcohol to the ATF; admixture of said ester or ester-alcohol into an additive package wherein the mineral oil constitutes from about 10 volume percent to about 70 volume percent of the additive package; and by modification of the ATF wherein mineral oil conventionally constitutes from about 70 volume percent to about 95 volume percent of the ATF. Preferred in this context is our seal swellant wherein dihexyl phthalate is present in an amount ranging from about 70 to about 100 volume percent of the total swellant with the balance being tridecyl alcohol.

DESCRIPTION OF THE PREFERRED EMBODIMENTS OF THE INVENTION

ATF systems are compounded from a number of additives each useful for improving a chemical and/or physical property of the ATF. The additives are usually sold as a package in which mineral oil is present. The mineral lubricating oil will constitute from 10 to 70 volume percent of the package and is a refined hydrocarbon oil or a mixture of refined hydrocarbon oils selected according to the viscosity requirements of the particular ATF but typically would have a viscosity range of 75–150 SSU at 100°F. Additives present in such packages include viscosity index improvers, corrosion inhibitors, oxidation inhibitors, friction modifiers, dispersants, de-emulsifiers, anti-foaming agents, anti-wear agents, pour point depressants and seal swellants.

The viscosity index improvers that may be employed in the ATF of this invention include any of the types known to the art including polyisobutylene, copolymers of ethylene and propylene, polymethacrylates, methacrylate copolymers, copolymers of an unsaturated dicarboxylic acid and a vinyl compound and interpolymers of styrene and acrylic esters.

Corrosion inhibitors, also known as anti-corrosive agents, reduce the degradation of the metallic parts contacted by the ATF. Illustrative of corrosion inhibitors are zinc dialkyl dithiophosphate, phosphosulfurized hydrocarbons and the products obtained by reaction of a phosphosulfurized hydrocarbon with an alkaline earth metal oxide or hydroxide, preferably in the presence of an alkylated phenol or of an alkyl phenol thioether, and also preferably in the presence of carbon dioxide. Phosphosulfurized hydrocarbons are prepared by reacting a suitable hydrocarbon such as a terpene, a heavy petroleum fraction of a $C_2$ to $C_6$ olefin polymer such as polyisobutylene, with from 5 to 30 weight percent of a sulfide of phosphorus for ½ to 15 hours, at a temperature in the range of 150° to 600°F. Neutralization of the phosphosulfurized hydrocarbon may be effected in the manner taught in U.S. Pat. No. 2,969,324.

Oxidation inhibitors reduce the tendency of mineral oils to deteriorate in service which deterioration is evidenced by the products of oxidation such as sludge and varnish-like deposits on the metal surfaces. Such oxidation inhibitors include alkaline earth metal salts of alkyl phenol thioethers having preferably $C_5$ to $c_{12}$ alkyl side chains, e.g. calcium nonyl phenol sulfide, barium t-octyl phenol sulfide, the high alkalinity alkaline earth metal sulfonates derived from hydrocarbon sulfonic acids in the 300 to 800 molecular weight range, zinc dialkyl dithiophosphates, dioctyl diphenyl amine, phenyl alpha naphthylamine, etc.

Friction modifiers adjust the frictional property of the ATF to optimize the actual performance of the automatic transmission. For example, if the coefficient of friction should increase in the clutches of certain automatic transmissions as the sliding speed decreases, stick-slip and possible squawk, i.e. audible stick-slip, can occur. In this case, also, a harsh shift is produced. To meet the requirements of "no squawk" and a smooth shift, a luricating oil for use in the transmission is needed whose change in coefficient of friction as the sliding speed of the friction members decreases, is minimal; even better is a fluid whose coefficient of friction decreases with a decreasing speed of the friction members, and whose coefficient of friction of static conditions is less than at high speeds. Numerous additives are used as friction modifiers to impart the desired frictional characteristics without adversely affecting fluid performance and include [in addition to those earlier referenced in U.S. Pat. Nos. 3,039,967; 3,410,801; and 3,446,737] calcium oleate, organic fatty acid amides and quaternary ammonium salts of unsaturated fatty acids, e.g. disoya dimethyl ammonium chloride.

Dispersants maintain oil insolubles resulting from oxidation during use in suspension in ATF thus preventing sludge flocculation and precipitation. Suitable dispersants include high molecular weight alkyl succinates, the reaction product of polyisobutylene-succinic anhydride with tetraethylene penta-amine and borated salts thereof.

Pour point depressants lower the temperature at which the ATF will flow or can be poured. Such depressants are well known. Typical of those additives which usefully optimize the low temperature fluidity of the ATF of the invention are $C_8$–$C_{18}$ dialkyl fumarate vinyl acetate copolymers, polymethacrylates, and was naphthalene condensation products.

A de-emulsifier suitable for the teachings of this disclosure is a commercially available blend of oxyalkylated materials sold as Breaxit 7937 by Exxon Chemical Company, U.S.A., Houston, Tex.

Foam control is provided by an anti-foamant of the polysiloxane type, e.g. silicone oil and polydimethyl siloxane.

Anti-wear agents, as their name implies, reduce wear of the transmission parts. Representative of suitable anti-wear agents are zinc dialkyl dithiophosphate, zinc diaryl dithiophosphate and magnesium sulfonate.

Some of these numerous additives can provide a multiplicity of affects, e.g. a dispersant-oxidation inhibitor. This approach is well knwon and need not be further elaborated herein.

The additive of this invention which has utility as a seal swellant is characterized as an oil soluble, saturated, aliphatic or aromatic hydrocarbon ester of from 10 to 60 carbon atoms and 2 to 4 ester linkages. These estes are the reaction products of 1. aliphatic (both linear and branched) alcohols having from 1 to 13 carbon atoms; and, polycarboxylic acids (including aliphatic dicarboxylic acids such as oxalic, succinic, adipic and sebacic; aliphatic tricarboxylic acids such as citric; aromatic dicarboxylic acids such as o-phthalic, m-phthalic and terephthalic; aromatic tricarboxylic acids such as trimellitic; and tetracarboxylic acids such as pyromellitic); and/or 2. polyols (including aliphatic dihydroxy compounds such as ethylene glycol, propylene glycol and hexylene glycol; aliphatic trihydroxy compounds such as trimethylol propane); and, monocarboxylic acids including aliphatic monocarboxylic acids of from 1 to 18 carbon atoms and aromatic acids such as benzoic and toluic.

The aromatic monocarboxylic and polycarboxylic acids may be further substituted with other functional groups such as hydroxyl or nitro groups. The aliphatic alcohol and polyols may be further substituted with other functional groups such as halogen, nitro, keto and phenyl groups.

As indicated above the aliphatic alcohols for forming the diester and triester are those alkanols of about 1 to about 13 carbon atoms, preferably 4 to 10 carbon atoms. These alcohols may be either straight chain or branched chain alcohols. Among the alcohols operable in preparing the esters of this preferred invention are hexanol, isooctanol, isononanol, isodecanol, tridecanol and the Oxo alcohols. The Oxo alcohols are prepared in a two-stage reaction. The first stage involves reacting olefins, such as polymers and copolymers of $C_3$ and $C_4$ monoolefins, with carbon monoxide and hydrogen at temperatures about 300° to 400°F. and pressures of about 30 to 400 atmospheres in the presence of a suitable catalyst to form a mixture of aldehydes having one carbon atom more than the olefin. In the second stage, the aldehyde mixture is hydrogenated, to form an isomeric mixture of highly branched chain primary alcohols which is recovered by distillation. The process has been described in U.S. Pat. Nos. 2,327,066 and 2,593,428.

The polycarboxylic acids for forming the diesters and triesters have been described above. Preferred among them are the phthalic acids, adipic acid and trimellitic acid for formation of the ester with the aliphatic alcohols having from 1 to 13 carbon atoms. For the phthalic and trimellitic acids, it is preferred to utilize their respective anhydrides for the esterification process. The dicarboxy and tricarboxy acid esters are prepared by conventional esterification techniques. The esterification is carried out by reacting 2 to 3 molar proportions of an alcohol (depending upon which ester is desired) per one molar proportion of the acid, under reflux conditions. Generally, a water-entraining agent, e.g. heptane is used, and the reaction is carried out until the calculated amount of water is removed overhead. A slight excess of alcohol can be used in order to insure completion of the reaction. Esterification catalysts, e.g. sodium methylate, calcium oxide, etc., are generally used when the complete esters are made, although the reaction may be carried out without a catalyst. A complex ester may be formed by producing first the partial esters of one alkanol and the polycarboxylic acid and thereafter reacting the partial ester with another alkanol. In any case, after the desired amount of water is removed, the remaining reaction product may be filtered and washed if a catalyst was used and then distilled under vacuum in order to remove the entraining agent and any unreacted alcohol overhead.

Various esterification methods involving polycarboxylic acids have been described in U.S. Pat. Nos. 3,099,682, 3,102,098 and 3,126,344 which methods are generally applicable to the materials of the present invention. The foregoing methods are also applicable to preparation of the polyol esters of the monocarboxylic acids.

The ester seal swellant of this invention is compatible and cooperative with a class of seal swelling additives fully described and claimed in U.S. Pat. No. 3,389,088, namely aliphatic alcohols of from 8 to 13 carbon atoms. Preferred for utilization with the esters in the practice of this invention is tridecyl alcohol. For purposes of full disclosure, the teachings of U.S. Pat. No. 3,389,088 is incorporated herein by this reference thereto. This preferred tridecyl alcohol is a mixtue of $C_{13}$ branched chain alcohols prepared by the Oxo process in which an olefin, as for example a $C_{12}$ olefin such as tetrapropylene, is reacted with carbon monoxide and hydrogen in the presence of a suitable catalyst and the resulting aldehydes are hydrogenated in a separate catalytic step to the tridecyl alcohol. Other useful alcohols are decyl alcohol, dodecyl alcohol, octyl alcohol and mixed $C_8$ alcohol produced by the Oxo process.

The seal swellant additive of the invention is used in ATF and for other lubrication uses such as for the rotary engine in amounts ranging from 0.1 to 5 volume percent. This seal swell additive is the described esters alone and in combination with up to equal volumes of the specified alcohols. For combinations of the ester-alcohol it is preferred that the ester be at least about 70 volume percent of the total seal swellant additive volume.

ATF lubricants contain many additives which are typically blended at the following range of treating levels.

| Components | Concentration Range. Volume % |
|---|---|
| Viscosity Index Improver | 1–15 |
| Corrosion Inhibitor | 0.01–1 |
| Oxidation Inhibitor | 0.01–1 |
| Friction Modifier | 0.01–1 |
| Dispersant | 0.5–10 |
| Pour point Depressant | 0.01–1 |
| De-emulsifier | 0.001–0.1 |
| Anti-foaming Agent | 0.001–0.1 |
| Anti-wear Agent | 0.001–1 |
| Seal Swellant (100% active) | 0.1–5 |

The nature of this invention may be better understood when reference is made to the following examples:

EXAMPLE 1

PREPARATION OF DIHEXYL PHTHALATE

The reactor consists of a round-bottom 4-neck, 1-liter flask fitted with a stirrer, thermometer, nitrogen sparger and condenser (connected through a Dean-Stark trap). Heat is supplied with an electric heating mantle.

One mole of phthalic anhydride, 2.2 moles (10% excess) of Oxo hexyl alcohol, 65 grams of toluene (entrainer) and ½ to 1 wt. % of toluene sulfonic acid (based on the theoretical yield of ester) are charged to the reactor. Air is swept out with nitrogen, as the contents are heated with stirring. The nitrogen purge is maintained throughout the course of the reaction. Heat is adjusted to maintain vigorous reflux (starting at about 120°C.) and the temperature slowly rises to about 150°C. over a period of 90–110 minutes.

The reaction is considered complete at a conversion of 99% as determined by titration of the free acidity (taking into account catalyst acidity). The course of the reaction is estimated by observing the volume of water collected in the Dean-Stark trap.

Following completion, the contents of the flask are cooled to about 85°C. (the temperature maintained throughout the neutralization and washing procedure). A quantity of 5% aqueous sodium hydroxide sufficient to neutralize the free acidity, plus an excess of about 10%, is added to the flask. Stirring is maintained for about 10 minutes. The caustic layer is then settled in a separatory funnel and drained off. This is followed by 2 or 3 hot-water washes to neutrality (wash volumes about 20% of the organic layer). The contents of the funnel are transferred to a short-path still and carbon black, is added (0.1–0.5 wt. %) if required for decolorization.

EXAMPLE 2

The dihexyl phthalate as prepared in Example 1 and other esters which can be similarly prepared were evaluated as seal swellant additives by measurement of volume and hardness change of rubber induced by exposure to said esters in a 4 volume percent concentration in mineral oil. The results are set forth in the following table:

| Ester | Vol. %* | Hardness Change** |
|---|---|---|
| Mineral Oil (no ester) | +0.7 | +4 |
| Dihexyl phthalate | +3.6 | −1 |
| Diisoctyl phthalate | +1.8 | +6 |
| Diisononyl phthalate | +1.9 | +3 |
| Diisodecyl phthalate | +1.5 | +4 |
| Ditridecyl phthalate | +1.2 | +4 |
| Di-n-butyl phthalate | +4.4 | −1 |
| Diisobutyl phthalate | +4.7 | −2 |
| Dioctyl adipate | +1.7 | +3 |
| Diisononyl adipate | +0.7 | +6 |
| Triisooctyl trimellitate | +2.2 | −1 |
| Triisononyl trimellitate | +1.0 | −4 |

*Test conducted under ASTM Procedure D-471-72.
**Test conducted under ASTM Procedure D-2240-68

EXAMPLE 3

Dihexyl phthalate (noted as DHP), a mixture of equal volumes of dihexyl phthalate and tridecyl alcohol (noted as DHP/TDA) and a commercial aromatic seal swellant were evaluated in commercial ATF blends formulated in a variety of mineral base oils (said blends did not contain any seal-swellant additive). The results, hereafter set forth, show comparable preformance of all the seal swellants.

| Blend | Added Seal Swellant (Vol.%) DHP | DHP/TDA | Aromatic | Vol. %* |
|---|---|---|---|---|
| A | 0 | 0 | 0 | −0.60 |
| | 0 | 0 | 2.0 | +2.00 |
| | 0 | 1.0 | 0 | +0.44 |
| | 1.0 | 0 | 0 | +0.33 |
| B | 0 | 0 | 0 | −0.60 |
| | 0 | 0 | 2.0 | +2.10 |
| | 2.0 | 0 | 0 | +1.60 |
| C | 0 | 0 | 0 | −1.90 |
| | 0 | 0 | 3.0 | +1.40 |

-continued

| Blend | Added Seal Swellant (Vol.%) DHP | DHP/TDA | Aromatic | Vol. %* |
|---|---|---|---|---|
| | 3.0 | 0 | 0 | +0.90 |
| D | 0 | 0 | 0 | +0.70 |
| | 0 | 0 | 0.9 | +1.40 |
| | 0 | 0.5 | 0 | +1.50 |
| E | 0 | 0 | 2.0 | +1.90 |
| | 1.0 | 0 | 0 | +0.70 |
| | 0 | 0.5 | 0 | +0.94 |

*Test conducted under ASTM Procedure D-471-72.

The data of Examples 3 and 4 is illustrative of the seal swelling properties of the subject matter of this invention.

EXAMPLE 4

Representative of the additive packages provided under the teachings herein are the following concentrate blends:

| Component (Additive) | Vol. % in Package A | B | C |
|---|---|---|---|
| Mineral Oil | 14 | 35 | 76 |
| Vis. Index improver | 24 | 40 | 8 |
| Corrosion inhibitor | 3 | 2 | 1 |
| Oxidation inhibitor | 3 | 2 | 1 |
| Friction modifier | 3 | — | 1 |
| Dihexyl phthalate/tridecyl alcohol* | 23 | 4 | 5 |
| Dispersant | 27 | 15 | 8 |
| Pour point depressant | — | — | — |
| De-emulsifier | — | — | 0.1** |
| Anti-foaming agent | 0.02** | 0.02** | 0.005** |
| Anti-wear agent | 3 | 2 | — |

*volume ratio phthalate:alcohol is 3:1. (100% active)
**wt. %

In such additive packages the range of mineral oil diluent for highly concentrated packages ranges from 10 to 20 percent of the total volume, in moderately concentrated packages from 20 to 40 percent of the total volume; and in dilute packages and ATF from 70 to 95 percent of the total volume.

A useful ATF is represented by the following formulation:

| Additive Type | Compound | Amount % |
|---|---|---|
| Diluent/Base Oil | Mineral Oil (100 neutral) | 94.2 |
| Viscosity Index Improver | polymethacrylate | 1.0 |
| Corrosion Inhibitor | phosphosulfurized terpene | 0.3 |
| Oxidation Inhibitor | phenyl alpha naphthylamine | 0.3 |
| Friction Modifier | calcium oleate | 0.4 |
| Seal swellant | dihexyl phthalate | 2.0 |
| Dispersant | amidated polyisobutylene succinate | 1.5 |
| Anti-wear agent | zinc dialkyl dithio phosphate | 0.3 |
| Anti-foamant | polydimethyl siloxane | 0.002 |

All percentages are in volume percent except for the antifoamant.

The seal swellant additives of the invention in their preferred embodiments have been tested according to and passed the General Motors Engineering Standards Specification G.M. 6137-M dated July 1973 (published by General Motors Corp. Research Lab., Warren, Mich.) and the Automatic Transmission Fluid Engineering Specifications M2C 33-F published by Ford Motor Co. on Aug. 1, 1968.

The volume percentages as used herein are all calculated at ambient temperatures and values are based on the total composition volume.

In the tests described in Examples 3 and 4 the rubber tested was Buna N rubber which is that type commonly used for rubber-type gaskets and seals in power transmission assemblies. The seal swellant of the invention is particularly useful for such a rubber type, however, it is also applicable to other elastomers commonly used for the fabrication of such seals and gaskets including silicone rubber, polyacrylate and fluorhydrocarbons.

The volume change test ASTM Procedure D-471-72 and the hardness change test ASTM Procedure D-2240-68 both involved measurement of a Buna N test specimen which was immersed in the test fluid maintained at 300°F. for 70 hours.

As earlier indicated the ester of preference as a seal swellent additive is dihexyl phthalate (20 carbon atoms) which is a member of a most useful class, i.e. the $C_4$ to $C_8$ alkanol esters of an aromatic dicarboxylic acid (16–24 carbon atoms) which appears from Example 2 to be highly effective. The $C_4$ to $C_{10}$ alkanol esters of aromatic dicarboxylic and tricarboxylic acids (16–36 carbon atoms) are seen therein to induce seal swelling in excess of that caused by the mineral oil alone.

The $C_1$ to $C_{13}$ alkanol tetraesters of pyromellitic acid (produced by the catalyzed reaction of pyromellitic dianhydride and alkanol or mixture of alkanols), particularly the $C_2$ to $C_8$ alkanol tetraesters, appear to have comparable seal swellant properties.

It is to be understood that esters of mixed alkanols are included as part of this teaching of seal swellants.

The ATF formulation earlier set forth is merely illustrative of a transmission fluid which could be useful for automatic transmissions as found on automobiles and trucks, power transmissions as found on farm equipment and earth movers and in rotary engines of the Wankel type in which the same fluid could be used for both lubrication and power transmission. Such formulations can vary in content and type of additives in a manner shown by the illustrative packages of Example 4. Similarly these illustrative packages may otherwise vary in the number of blended additives, e.g. often times the viscosity index improver is not present in the additive package. In a preferred system of packages and ATF, a friction modifier is blended with our seal swellant in a mineral oil base stock.

The additives having the functions of viscosity index improving, corrosion inhibition, dispersing, antiwearing and friction modifying are normally blended into the packages and into ATF as a concentrate which consists of the active additive in mineral oil, e.g. an illustrated V.I. concentrate is 7 wt. % ethylene-propylene copolymer and 93 wt.% of mineral oil.

It is to be understood that the examples present in the foregoing specification are merely illustrative of this invention and are not intended to limit it in any manner; nor is the invention to be limited by any theory regarding its operability. The scope of the invention is to be determined by the appended claims.

What is claimed is:

1. In a method of operating a vehicular automatic transmission having rubber seals subject to deterioration and leakage, the improvement of using an automatic transmission fluid comprising about 70 to 95 volume percent of mineral lubricating oil, and about 0.1 to 5 volume percent of a seal swell additive which is 70 to 100 volume percent of an oil soluble, aromatic hydrocarbon ester of 10 to 60 carbon atoms and 2 to 3 ester linkages, said ester being the reaction product of an aliphatic alcohol having from 1 to 13 carbon atoms and an aromatic polycarboxylic acid having 2 to 3 carboxylic acid groups, said ester having the property of swelling said seals to thereby prevent leakage.

2. In a method according to claim 1, wherein said ester is an ester of a $C_4$ to $C_{10}$ alkanol with said aromatic carboxylic acid and wherein said ester contains a total of 16 to 36 carbon atoms.

3. In a method according to claim 2, wherein said ester is an ester of a $C_4$ to $C_{10}$ alkanol and an aromatic dicarboxylic acid, said ester containing a total of 16 to 24 carbon atoms.

4. In a method according to claim 3, wherein said dicarboxylic acid is phthalic acid.

5. In a method according to claim 4, wherein said ester is dihexyl phthalate.

6. In a method according to claim 1, wherein said seal swellant additive consists essentially of said ester.

7. In a method according to claim 1, wherein said seal swell additive includes within the range of 30 to 0 volume percent of an aliphatic alcohol of from 8 to 13 carbon atoms which cooperatively with said ester imparts to said fluid the seal swelling property.

8. In a method according to claim 7, wherein said alcohol is tridecyl alcohol.

9. In a method according to claim 8, wherein said seal swellant is a mixture of dihexyl phthalate and tridecyl alcohol.

10. In a method according to claim 8, wherein said fluid comprises conventional ATF additives which includes in combination: a viscosity index improver, a friction modifier, an oxidation inhibitor, a dispersant, an antiwear agent and an antifoamant.

* * * * *